PROCESS FOR MANUFACTURING REGENERATED LEATHER

BACKGROUND OF THE INVENTION

This invention relates to a process for manufacturing regenerated natural leather.

Although synthetic leather is competitive with natural leather in price, yet consumers prefer natural leather because of its hand feeling. Synthetic leather does not give realistic feeling and value as natural leather does because the former can be distinguished from the back side of the latter simply from its base cloth made of non-woven fabrics or knitted cloth.

Heretofore, there has been no any process of regeneration for wasted natural leather, therefore, all the scraps in a tannery or a leather processing factory are thrown away and become a waste of material.

SUMMARY OF THE INVENTION

Based on the discovery that by preparing and sending a short-fiber leather pulp and a long-fiber leather pulp to a refrigerator for freezing and then drying in a vacuum dryer, thus two sheets of cake-like leather are formed; by combining the two sheets to one and dipping with a proper bonding agent and lastly by fluffing the long-fiber leather sheet, thus the inventor has successfully regenerated a wasted natural leather.

The "wasted natural leather" referred to in this invention means scrap or disposed leather which is useless and its protein and collagens were removed and tanned from semi-product or product that may be found in a tannery or leather processing factories such as for gloves, jackets, handbags, luggages or shoes, etc.

The product from this invention gives us a realistic hand feeling as that of natural leather. If the product from this invention is observed from the back side, it is no different to natural leather. The regenerated natural leather according to this invention can be used for the purpose of any natural leather, such as gloves, shoes, jackets, handbags, etc.

The process according to this invention includes preparing a short-fiber and a long-fiber leather pulps from the wasted natural leather; impregnating the short-fiber leather pulp to a release paper which has been precoated with polyurethane (water process, hereunder referred to as PU) and placed on a tray; impregnating the long-fiber leather pulp to a separate tray which a base cloth has advancely placed; sending the two trays to a refrigerator for freezing; sending the products to a vacuum dryer for dehydration thus obtained an upper leather sheet and a lower leather sheet from the short-fiber leather pulp and long-fiber leather pulp respectively; combining the two sheets as one and sending it for pressing to an even thickness and dipping PU resin which contains dimethyl formamide solvent; scrubbing the excess resin after PU has been infiltrated fully into the leather sheet; rinsing off the dimethyl formamide solvent; flattening it to an even thickness; drying it; and after cooling, fluffing its back side and taking off the release paper, thus a regenerated natural leather is formed. The preparation of short-fiber leather pulp includes, firstly cutting the wasted natural leather into pieces; adding alkali solution and heating the mixture to an elevated temperature to form chrome hydroxide; removing excess alkali; then adding acid and heating it to an elevated temperature to form chrome salt; filtering and removing chrome salt; after decoloring, adjusting PH to 6~8.5; and finally removing excess water to keep water content within 85~95% thus a short-fiber leather pulp is formed. The preparation of long-fiber leather pulp includes, firstly fiberizing the wasted natural leather into 0.5~1.0 cm of fiber in length; scutching them to separate fibers from leather pieces and then separating the fibers and un-fiberized leather pieces; soaking the leather fibers in water; after decolorization; then adjusting PH to about 6~8.5 and maintaining water content to about 85~95% and dying to the desired color thus a long-fiber leather pulp is formed.

It is an object of the invention to provide a process for manufacturing regenerated natural leather.

Another object of the invention is to provide a regenerated natural leather.

Other and further objects, features and advantages of the invention will appear more fully from the following description.

Figure 1:
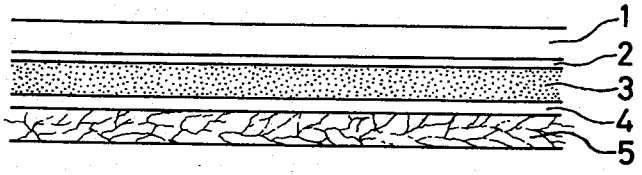
FIG. 1 is an enlarged sectional view of the regenerated natural leather according to this invention.
Figure 2:
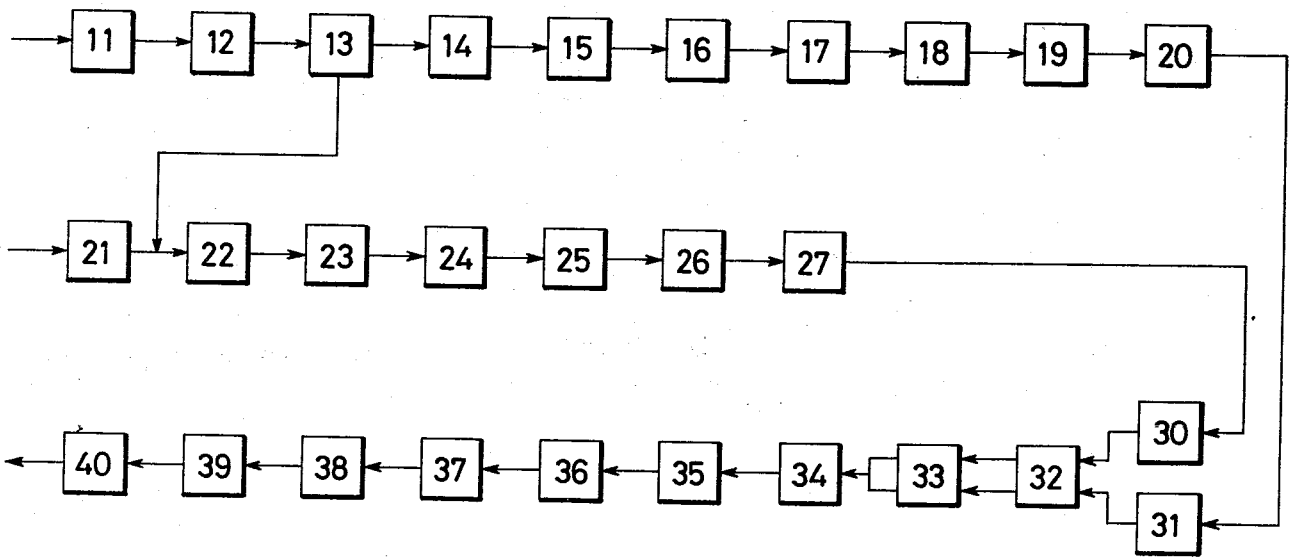
FIG. 2 is a flow sheet illustrating the invention process in a sequential form.

The process of this invention is now referred to the attached drawing for detailed explanation.

DETAILED DESCRIPTION OF THE INVENTION

Preparation of Short-Fiber Leather Pulp

Choose dried wasted natural leather and cut into pieces by cutter 11 and then mixed, if any, with the unfiberized pieces as formed in long-fiber leather pulp preparation. Send the mixture to a bloat tank 12 and add water, preferably 4~6 weight times based on the total weight of mixture, and stir for a certain period of time and then add alkali solution, preferably 45% NaOH aqueous solution, which is preferably 2.5 weight % based on its total weight. In elevated temperature, stir for another period of time until the pieces are expanded and the chrome contained therein reacted with alkali to form chrome hydroxide. In a filter 13, the pieces are dehydrated and then water are added. After grinding in a pulp refiner 14, a short-fiber leather pulp is thus formed. By adding acid solution, preferably HCl, in the amount of, preferably 3.3 weight % of the total pulp in a chrome releasing tank 15, the product is heated to elevated temperature and stirred, until chrome hydroxide is reacted with acid to form chrome salt which is then separated by filter 16. After decoloring in decolorization tank 17, the PH value is to be adjusted by alkali in PH adjustment tank 18 to about 6~8.5. The product is dehydrated in a filter 19 and the water content is adjusted in water content adjustment tank 20 to about 85~95%, thus a short-fiber leather pulp is formed.

Preparation of Long-Fiber Leather Pulp

Choose dried wasted natural leather and fiberize in a fiberizing machine 21 and then scutch the fibers from leather pieces in leather dreg scutching machine 22. The unfiberized pieces are separated by a cyclone 23 and are later used for preparing short-fiber leather pulp. The residues are passed through a decolorization tank 24 for decolorization. The PH value of which is adjusted by adding $H_2O$ in PH adjustment tank 25 to about 6~8.5, then they are sent to a filter 26 for dehydration. The water content of the product is adjusted to about 85~95% and dyed to the desired color in tank 27. Thus a long-fiber pulp is formed.

Manufacture of Regenerated Leather

Referring to FIG. 1, the release paper 1 with embossed pattern of natural leather is coated with PU resin 2 and which is then placed in a stainless steel square tray 31. The short-fiber leather pulp 3 is impregnated on the paper. The soft base cloth 4 made of non-woven fabrics or knitted cloth is coated with PU on both sides and put in a stainless steel square tray 30. The long-fiber leather pulp 5 is impregnated on the cloth. Trays 30 and 31 are separately sent to a refrigerator 32 for freezing. Then they are sent to a vacuum dryer 33 for dehydration. After taking out from the dryer, the two sheets are combined in the order of release paper 1, short-fiber leather 3, base cloth 4 and long-fiber leather 5. Then it is sent to a press 34 for pressing to about 1.5~2.5 mm in thickness. The leather prepared is dipped with a PU resin of preferably 2000~3000 cps, in which it contains about preferably 50% DMF solvent, in a vacuum dipping chamber 35. After PU resin has been fully infiltrated the leather, the excess PU resin is scrubbing off in table 36. The excess PU resin can be recycled for further use. DMF solvent is washed with water in washing tank 37. Then the product is flat-pressed to about 1.5~2.5 mm in thickness in a press 38. Lastly the product is sent to a drying oven 39 for drying. After cooling, the back side of the product is fluffed in a fluffing machine 40 and remove the release paper. Thus a regenerated natural leather is obtained.

The following example is included merely to aid in the understanding of the invention, and variations may be made by one skilled in the art without departing from the spirit and scope of the invention.

EXAMPLE

Preparation of Short-Fiber Leather Pulp

Dried cowhide scraps 20 kgs were chosen and cut into pieces by cutter 11. They were mixed with the unfiberized pieces as formed in long-fiber leather pulp preparation. Then they were sent to bloat tank 12 by adding 5 times (weight) of water and stirring it for 20 minutes before 45% NaOH aqueous solution, which is 2.5 weight % based on its total weight, was added. It was later heated to 40° C. and stirred for another 1 hour, and the pieces became expanded and the chrome contained therein reacted with NaOH to form chrome hydroxide. Then, the pieces were dehydrated in continuous vacuum filter 13, water was added and then they were grinded in pulp refiner 14 to form leather pulp. Afterwards, in chrome releasing tank 15, by adding 32% of HCl solution, which is 3.3 weight % of total pulp, it was heated to 40° C. and then stirred for another 3 hours, chrome hydroxide was then reacted with HCl to form chrome chloride and separation was performed by filter 16. After decolorization was done in tank 17, the PH value was adjusted by NaOH in tank 18 to 7.5. Thus, a short-fiber leather pulp was formed by dehydrating the product in continuous vacuum filter 19 and maintaining water content to about 95% in tank 20.

Preparation of Long-Fiber Leather Pulp

Dried cowhide scraps 20 kgs were chosen and fiberized in a fiberizing machine 21 to about 0.5~1 cm of fiber in length. They were scutched cy leather drey scutching machine 22 to separate fibers from leather pieces. Further they were sent through cyclone 23 to separate the un-fiberized pieces which later were to be used for preparing short-fiber leather pulp. The residues were then passed through tank 24 for decolorization. Later, by adding $H_2O$ to adjust the PH in PH adjustment tank 25 to about 7.5, they were sent to continuous vacuum filter 26 for dehydration. Finally the water content of the product was adjusted to about 95% and proper dyes were added for desired color in tank 27. Thus a long-fiber leather pulp was formed.

Manufacture of Regenerated Leather (A) The release paper 1 with embossed pattern of natural leather was coated with PU resin of 0.15 mm in thickness and which was then placed in stainless steel square tray 31. The short-fiber leather pulp 3 was impregnated 1.5 mm in thickness on the paper.

(B) The soft base cloth 4 made of knitted cloth was coated with PU on both sides and put in stainless steel square tray 30. The long-fiber leather pulp 5 was impregnated about 1 mm in thickness on the cloth.

(C) The sheets prepared in (A) & (B) were sent separately to refrigerator 32 for 2 hours of freezing. Then they were sent to vacuum dryer 33 of 55° C. 0.02 Torr for dehydration for 10 hours. After taking them out from dryer, the two sheets were combined in the order of: release paper 1, short-fiber leather 3, base cloth 4 and long-fiber leather 5 (as shown in FIG. 1). Then it was sent for pressing in oil press 34 to about 2.0 mm in thickness.

(D) The leather prepared in (C) was dipped with a PU resin of 3000 cps, in which it contains about 50% DMF solvent, in vacuum dipping chamber 35 for 1 hour. After the PU resin had been fully infiltrated the leather, it was taken out for scrubbing off the excess PU resin in table 36. The excess PU resin could be recycled for further use. After rinsing off with water for 20 minutes in washing tank 37, DMF solvent was washed off. Then it was flat-pressed to about 1.6 mm thickness in oil press 38. Lastly, it was sent for drying in infrared ray drying oven 39 for ½ hour. After it was cooled, the back side was fluffed in fluffing machine 40 and the release paper was removed. Thus a regenerated natural leather was obtained.

The properties of this regenerated natural leather are shown in Table 1.

TABLE 1

| | | | |
|---|---|---|---|
| Thickness: 1.6 mm | Weight: | 460 g/m$^2$ | |
| Teisile strength (kg/cm) | Vertical | 16.1 | 23° C. dry |
| | horizontal | 15.3 | " |
| Elongation percentage (%) | Vertical | 35 | " |
| | horizontal | 40 | " |
| Tearing strength test (kg) | Vertical | 3 | " |
| | horizontal | 4.2 | " |
| Fade test (Wet grey scale) | 5 | | |
| Iron test | 100~120° C. | | passed |
| Surface rubbing test | >1000 times | | |
| Heat & cold test (Flex) | −30° C.~130° C. | | passed |
| Water penetrate test | 2.5 g/cm$^2$/h | | |
| (Hand feeling) | identical to a natural leather | | |

What I claim is:

1. A process for manufacturing regenerated leather characterized by preparing a short-fiber and a long-fiber leather pulps from wasted natural leather; sending the two kinds of pulp separately to a refrigerator for freezing and then drying in a vacuum dryer, thus form two sheets of cake-like leather; combining the two sheets to one and dipping with proper bonding agent; fluffing the long-fiber leather sheet by a fluff-forming machine thus to form a regenerated natural leather.

2. A process for manufacturing regenerated leather characterized by preparing a short-fiber and a long-fiber leather pulps from the wasted natural leather; impregnating the short-fiber leather pulp to a release paper which has been pre-coated with polyurethane and placed on a tray; impregnating the long-fiber leather pulp to a separate tray which a base cloth has advancely placed; sending the two trays to a refrigerator for freezing; sending the products to a vacuum dryer for dehydration thus obtained an upper leather sheet and a lower leather sheet from the short-fiber leather pulp and long-fiber leather pulp respectively; combining the two sheets as one and sending it for pressing to an even thickness and dipping PU resin which contains dimethyl formamide solvent; scrubbing the excess resin after PU has been infiltrated fully into the leather sheet; rinsing off the dimethyl formamide solvent; flattening it to an even thickness; drying it; and after cooling, fluffing its back side and taking off the release paper thus form a regenerated natural leather.

3. A process according to claim 1 or 2 wherein the preparation of short-fiber leather pulp is characterized by: firstly cutting the wasted natural leather into pieces; adding alkali solution and heating the mixture to form chrome hydroxide; removing excess alkali; then adding acid and heating it to form chrome salt; filtering and removing chrome salt; after decoloring, adjusting PH to 6~8.5; and finally removing excess water to keep water content within 85~95% thus forms a short-fiber leather pulp.

4. A process according to claim 1 or 2 wherein the preparation of long-fiber leather pulp is characterized by: firstly fiberizing the wasted natural leather into 0.5~1.0 cm of fiber in length; scutching them to separate fibers from leather pieces and then separating the fibers and unfiberized leather pieces; soaking the leather fibers in water; after decolorization, then adjusting PH to about 6~8.5 and maintaining water content to about 85~95% and dying to the desired color thus forms a long-fiber leather pulp.

5. A process according to claim 1 or 2 wherein the said freezing is performed in a refrigerator of −30°~−40° C. and the said drying is performed in a vacuum dryer of 45°~60° C.

* * * * *